US007315133B2

(12) United States Patent
Suzuki

(10) Patent No.: US 7,315,133 B2
(45) Date of Patent: Jan. 1, 2008

(54) DISCHARGE LAMP LIGHTING APPARATUS

(75) Inventor: Shinichi Suzuki, Kitasaku-gun (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 11/488,661

(22) Filed: Jul. 19, 2006

(65) Prior Publication Data

US 2007/0024205 A1 Feb. 1, 2007

(30) Foreign Application Priority Data

Jul. 28, 2005 (JP) ..... 2005-218944

(51) Int. Cl.
*H05B 37/02* (2006.01)

(52) U.S. Cl. ..... 315/209 R; 315/308

(58) Field of Classification Search ..... 315/209 R, 315/210, 211, 212, 219, 224, 225, 226, 291, 315/307, 308, DIG. 2, DIG. 5, DIG. 7
See application file for complete search history.

(56) References Cited

U.S. PATENT DOCUMENTS 7,141,937 B2 * 11/2006 Kumagai et al. ..... 315/224
2003/0161164 A1 * 8/2003 Shannon et al. ..... 363/40
2004/0240234 A1 * 12/2004 Toda et al. ..... 363/22

FOREIGN PATENT DOCUMENTS

JP A 2005-38683 2/2005

* cited by examiner

*Primary Examiner*—Thuy Vinh Tran
(74) *Attorney, Agent, or Firm*—Oliff & Berridge, PLC

(57) ABSTRACT

A discharge lamp lighting apparatus is provided which includes: a high-voltage transformer; a switching circuit to drive the primary side of the transformer; a frequency changing means to change an operating frequency of the switching circuit according to lighting conditions of a discharge lamp; and first and second resonant circuits formed respectively at the primary and secondary sides of the transformer and having respective specific resonant frequencies different from each other. The switching circuit, before the discharge lamp is turned on, operates at a frequency ranging in proximity of the series resonant frequency of the secondary resonant circuit, and after the discharge lamp is turned on, operates at a frequency ranging in proximity of a frequency at which a voltage-current phase difference at the primary side of the transformer is minimized. The capacitance component of the second resonant circuit is constituted by a parasitic capacitance only.

6 Claims, 4 Drawing Sheets

DISCHARGE LAMP LIGHTING APPARATUS

BACKGROUND OF THE INVENTION

1. Field of the Invention

The present invention relates to a discharge lamp lighting apparatus, and particularly to a discharge lamp lighting apparatus for lighting a discharge lamp as a light source of a backlight device for use in a liquid crystal display device.

2. Description of the Related Art

A liquid crystal display (LCD) which is used as a display device for an LCD television apparatus, and the like does not emit light by itself, and therefore needs a lighting device such as a backlight device. A discharge lamp such as a cold-cathode lamp is extensively used as a light source for a backlight device, and a high AC voltage required to light such a discharge lamp is usually gained by boosting the output of an inverter circuit by means of a high-voltage transformer.

A discharge lamp lighting apparatus is currently disclosed which has a series resonant circuit formed at the secondary side of a high-voltage transformer and which is provided with an H-bridge circuit to drive the primary side of the high-voltage transformer at a frequency which is lower than the resonant frequency of the series resonant circuit, and at which the voltage-current phase difference at the primary side of the high-voltage transformer stays within a predetermined range from the minimum value (refer to, for example, Japanese Patent Application Laid-Open No. 2005-038683).

FIG. 6 is a block diagram showing a circuitry of such a discharge lamp lighting apparatus as described above. Referring to FIG. 6, in a discharge lamp lighting apparatus 100, a series resonant circuit is formed at the secondary side of a high-voltage transformer 101 by a leakage inductance of the high-voltage transformer 101, capacitors 131 and 132, and a parasitic capacitance 103 generated at the periphery of a discharge lamp 109, wherein the operating frequency of an H-bridge circuit 117 to drive the primary side of the high-voltage transformer 101 is set lower than the resonant frequency of the series resonant circuit and also set such that a voltage-current phase difference θ at the primary side of the high-voltage transformer 101 stays within a predetermined range from the minimum value, whereby the high-voltage transformer 101 achieves an enhanced power efficiency.

The capacitors 131 and 132 connected to the secondary side of the high-voltage transformer 101 function as auxiliary capacitance for the parasitic capacitance 103, and the resonant frequency of the series resonant circuit formed at the secondary side of the high-voltage transformer 101 can be set as intended by adjusting the capacitance values of the capacitors 131 and 132. The capacitors 131 and 132 function also as a voltage detecting means when the secondary side is open. A signal 133 divided by the capacitors 131 and 132 is sent to an error amplifier 151 for voltage feedback, and an output voltage 152 from the error amplifier 151 is inputted to a protection circuit 150 and a pulse width modulation (PWM) circuit 108. The protection circuit 150, when the output voltage 152 of the error amplifier 151 exceeds a predetermined threshold value, is adapted to stop the function of a logic circuit 129 thereby preventing overcurrent from flowing into the discharge lamp 109. A current-voltage circuit 110 to convert a lamp current into voltage is connected to the discharge lamp 109, an output voltage 109*a* of the discharge lamp 109 is inputted to an error amplifier 111, and the error amplifier 111 outputs to the PWM circuit 108 an output voltage 112 according to the current of the discharge lamp 109, whereby constant current control based on pulse width modulation is performed.

In the discharge lamp lighting apparatus 100 described above, the output voltage at the secondary side of the high-voltage transformer 101 is divided by means of the capacitors 131 and 132 so as to produce a signal, and an open voltage is detected by using the signal for preventing excess output voltage when the secondary side is open. Accordingly, the capacitors 131 and 132 are required to withstand a high voltage, thus inviting cost increase. Especially, an LCD used as a display device in a large television apparatus has a large display area dimension and needs a backlight device incorporating a plurality of discharge lamps in order to achieve a high brightness across the display area, thus increasing usage numbers of the capacitors 131 and 132, which aggravates the cost increase issue.

SUMMARY OF THE INVENTION

The present invention has been made in light of the above problem, and it is an object of the present invention to provide a discharge lamp lighting apparatus using a reduced number of high voltage-resistant components at the secondary side of a high-voltage transformer thereby reducing cost and at the same time achieving a stable circuit operation with a high efficiency.

In order to achieve the object described above, according to an aspect of the present invention, there is provided a discharge lamp lighting apparatus which includes: a high-voltage transformer defining a primary side and a secondary side; a switching circuit to drive the primary side of the high-voltage transformer; a discharge lamp connected to the secondary side of the high-voltage transformer; a frequency changing means to change an operating frequency of the switching circuit according to lighting conditions of the discharge lamp before and after the discharge lamp is turned on; a first resonant circuit formed at the primary side of the high-voltage transformer and having a specific resonant frequency; and a second resonant circuit formed at the secondary side of the high-voltage transformer and having a specific resonant frequency different from the resonant frequency of the first resonant circuit. In the discharge lamp lighting apparatus described above, when the discharge lamp is not lighted before turned on, the switching circuit is operated at a frequency ranging in proximity of a series resonant frequency of the second resonant circuit, and when the discharge lamp is lighted after turned on, the switching circuit is operated at a frequency ranging in proximity of a frequency at which a voltage-current phase difference at the primary side of the high-voltage transformer is minimized. With the structure described above, a voltage high enough to start lighting the discharge is duly gained thereby allowing the discharge lamp to be surely lighted, and the discharge lamp can be then kept lighted at a frequency at which the high-voltage transfer can operate with the maximum power efficiency In the aspect of the present invention, the capacitance component of the first resonant circuit may be constituted by a capacitor connected either in series or parallel to a primary winding of the high-voltage transformer, and the capacitance component of the second resonant circuit may be constituted by a parasitic capacitance only. Thus, high-voltage resistant capacitors are eliminated from the secondary side of the high-voltage transformer, which results in a significant cost reduction of the apparatus, and at the same time the number of portions where a high-voltage is generated is decreased at the secondary side of the high-voltage transformer thus reducing the generation of hazards such as arc discharge, which contributes to enhancing the quality of the apparatus.

In the aspect of the present invention, the resonant frequency of the first resonant circuit may preferably be set lower than a parallel resonant frequency of the second resonant circuit. Consequently, the discharge lamp lighting apparatus can operate stably.

In the aspect of the present invention, the discharge lamp lighting apparatus may further include an error amplifier to set an open voltage, wherein an output voltage, when the secondary side of the high-voltage transformer is open, is controlled according to the supply voltage and the predetermined reference voltage, both of which are inputted to the error amplifier. This enables a desired open voltage to be gained without feedback from the secondary side of the high-voltage transformer.

In the aspect of the present invention, the switching circuit may preferably be either a full-bridge circuit or a half-bridge circuit, and the series resonant frequency of the second resonant circuit formed at the secondary side of the high-voltage transformer may be determined by a leakage inductance at a secondary winding of the high-voltage transformer and a parasitic capacitance at the secondary side.

Thus, the present invention contributes to providing a discharge lamp lighting apparatus which reduces the number of high-voltage resistant components at the secondary side of the high-voltage transformer thereby achieving cost reduction, and which operates stably with a high efficiency.

DETAILED DESCRIPTION OF THE INVENTION

Exemplary embodiments of the present invention will be described with reference to the accompanying drawings.

Figure 1:
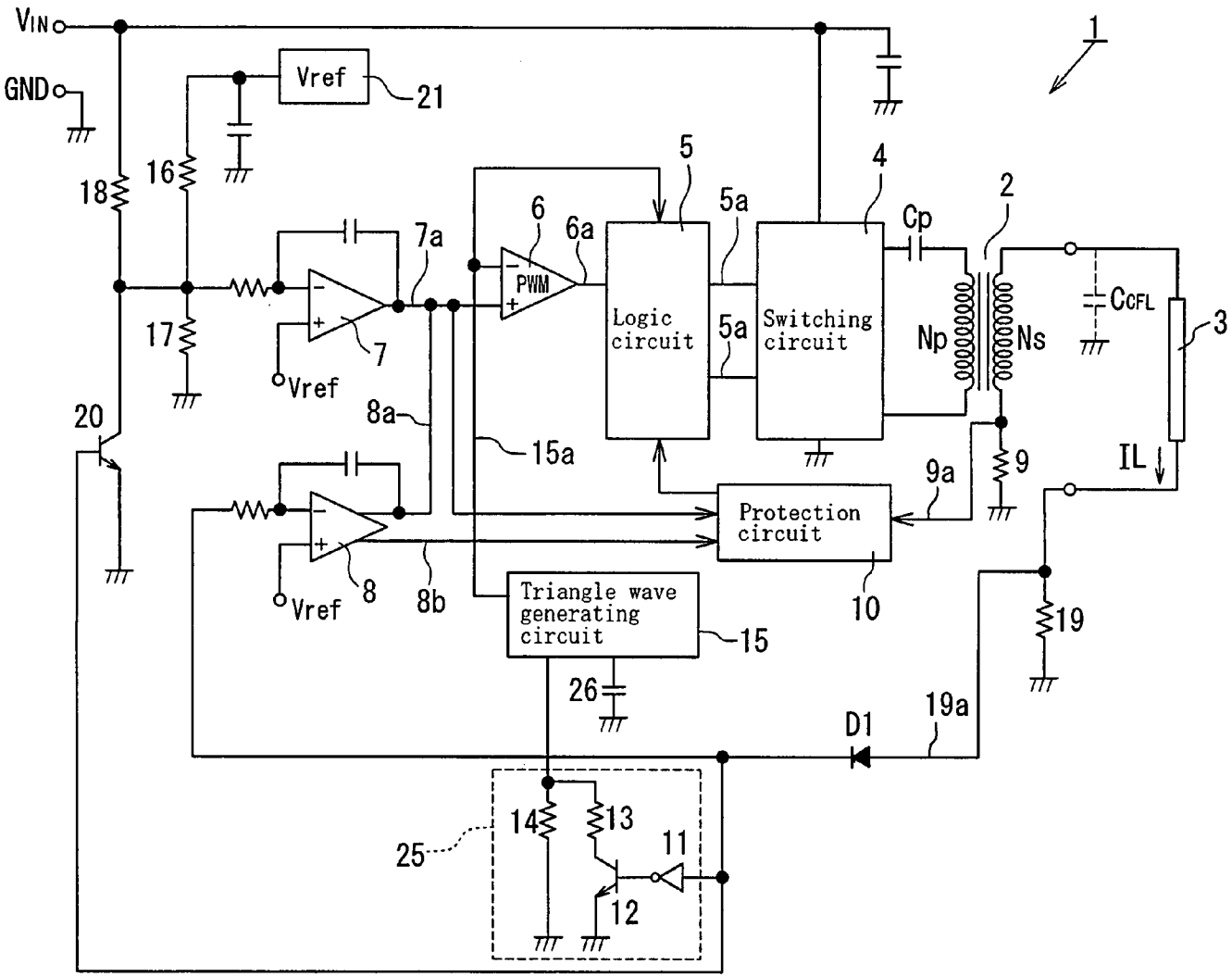
FIG. 1 is a block diagram of a discharge lamp lighting apparatus according to a first embodiment of the present invention.

Referring to FIG. 1, a discharge lamp lighting apparatus 1 according to a first embodiment of the present invention includes a high-voltage transformer 2, and a switching circuit 4 to drive the primary side of the high-voltage transformer 2, and a discharge lamp 3, for example a cold-cathode lamp, is connected to the secondary side of the high-voltage transformer 2. In the present embodiment, the high-voltage transformer 2 is a leakage flux type transformer which has its secondary winding having a leakage inductance of at least 40 mH, preferably about 300 mH. The discharge lamp 3 has its one terminal connected to a secondary winding Ns of the high-voltage transformer 2 and hast the other terminal grounded via a lamp current detecting resistor 19. A capacitance $C_{CFL}$ is a parasitic capacitance generated at the periphery of the discharge lamp 3. The switching circuit 4 is connected to the primary side of the high-voltage transformer 2 via a capacitor Cp connected in series to a primary winding Np of the high-voltage transformer 2. The capacitor Cp may alternatively be connected in parallel to the primary winding Np.

Figure 2:
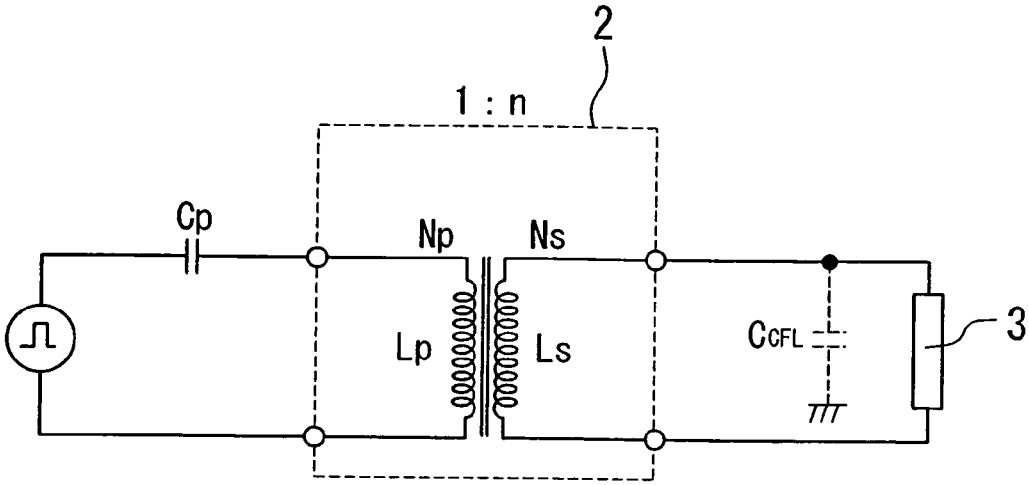
FIG. 2 is a circuit diagram of a portion relevant to a high-voltage transformer shown in FIG. 1.

Referring to FIG. 2, the winding ratio of the secondary winding Ns of the high-voltage transformer 2 to the primary winding Ns is defined as "n". In the present embodiment, a resonant circuit is formed at each of the primary and secondary sides of the high-voltage transformer 2, wherein each resonant circuit has a specific resonant frequency different from the other. The resonant circuit at the primary side is composed of a self-inductance Lp of the primary winding Np and the aforementioned capacitor Cp, and the resonant circuit at the secondary side is composed of a self-inductance Ls of the secondary winding Ns and the aforementioned parasitic capacitance $C_{CFL}$ present at the periphery of the discharge lamp 3.

Figure 3:
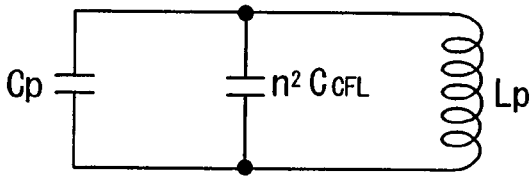
FIG. 3 is an equivalent circuit schematic of a resonant circuit at the primary side of the high-voltage transformer of the FIG. 2.

Referring to FIG. 3, in the resonant circuit at the primary side, a capacitance $n^2C_{CFL}$ is a parasitic capacitance seen at the primary side. In the present embodiment, the capacitor Cp is set to have a capacitance by far larger than the capacitance $n^2C_{CFL}$ ($Cp \gg n^2C_{CFL}$), and a resonant frequency fp of the resonant circuit at the primary side is represented by the following equation: $fp=1/(2\pi\sqrt{(Lp \cdot Cp)})$.

Figure 4:
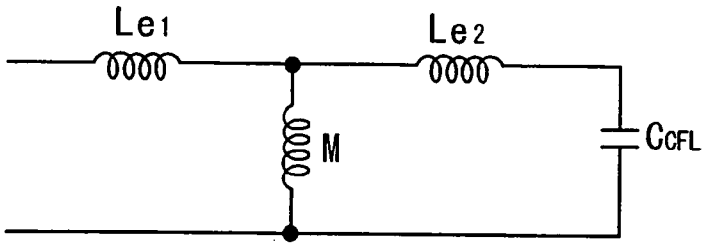
FIG. 4 is an equivalent circuit schematic of a resonant circuit at the secondary side of the high-voltage transformer of FIG. 2.

Referring to FIG. 4, in the resonant circuit at the secondary side, M refers to a mutual inductance of the high-voltage transformer 2, Le1 refers to a leakage inductance produced at the primary side, and Le2 refers to a leakage inductance produced at the secondary side. In the resonant circuit thus structured, a series resonant frequency fss is given by the leakage inductance Le2 and the parasitic capacitance $C_{CFL}$ as follows: $fss=1/(2\pi\sqrt{(Le2 \cdot C_{CFL})})$, and a parallel resonant frequency fsp is given by the self-inductance Ls (Ls=M+Le2) of the secondary winding Ns and the parasitic capacitance $C_{CFL}$ as follows: $fsp=1/(2\pi\sqrt{(Ls \cdot C_{CFL})})$. Accordingly, the inequality of "fsp<fss" is established, and thus the resonant frequency fp of the resonant circuit at the primary side is set to be lower than the parallel resonant frequency fsp of the resonant circuit at the secondary side (fp<fsp).

Referring again to FIG. 1, the operation of the discharge lamp lighting apparatus 1 according to the present embodiment will hereinafter be described. The switching circuit 4 is either a full-bridge circuit composed such that two series circuits each of which has two switching elements (for example, power MOSFET) connected to each other in series are connected to each other in parallel, or a half-bridge circuit composed of a series circuit which has two switching elements connected to each other in series, wherein the on-off control of the switching elements is performed by signals (gate signals) 5*a* outputted from a logic circuit 5. The operating frequency of the switching circuit 4 is determined based on the frequency of a triangle wave 15*a* outputted from a triangle wave generating circuit 15, and the discharge lamp lighting apparatus 1 includes, in addition to the triangle wave generating circuit 15, a frequency changing means 25 which is composed of resistors 13 and 14, a transistor 12, and an inverter element 11. The on-duty of the switching elements constituting the switching circuit 4 is controlled by a pulse signal 6*a* from a PWM circuit 6, and the discharge lamp lighting apparatus 1 includes an error amplifier 7 to set an open voltage in addition to an error amplifier 8 to set a lamp current, wherein the pulse width modulation control by the PWM circuit 6 is performed based on comparison of output voltages 7*a* and 8*a* from the error amplifiers 7 and 8 with the triangle wave 15*a*.

The operation of the discharge lamp lighting apparatus 1 will be further described below. Description will first be made on the operation at the moment an input voltage $V_{IN}$ is supplied but the discharge lamp 3 is not yet turned on. A lamp current IL is converted into a feedback voltage signal 19*a* by the aforementioned lamp current detecting resistor 19 and inputted into the frequency changing means 25 via a diode D1. Since, immediately after the input voltage $V_{IN}$ is supplied, the lamp current IL is yet to start flowing, the inverter element 11 of the frequency changing means 25 produces a high level of output thereby turning on the transistor 12. Thus, it is assumed that a combined resistance composed of the resistors 13 and 14 connected to each other in parallel is connected to the triangle wave generating circuit 15, and so the frequency of the triangle wave 15*a* is determined according to the value of the combined resistance and the value of a capacitor 26. In the present embodiment, when the discharge lamp 3 is not turned on, the frequency of the triangle wave 15*a* is set at a frequency (hereinafter denoted "fo") ranging in the proximity of the series resonant frequency fss of the resonant circuit at the secondary side.

The feedback voltage signal 19*a* is applied also to the base terminal of a transistor 20 via the diode D1, but since the lamp current IL is not flowing immediately after the input voltage $V_{IN}$ is supplied, the transistor 20 is kept turned off. Consequently, a voltage, which is determined by the input voltage $V_{IN}$, a reference voltage Vref from a reference voltage circuit 21, and resistors 16, 17 and 18, is inputted to the inverting input terminal of the error amplifier 7, and the output voltage 7*a* of the error amplifier 7, which is determined according to the error deviation from the reference voltage Vref inputted to the non-inverting input terminal of the error amplifier 7, is sent to the PWM circuit 6. The PWM circuit 6 then compares the triangle wave 15*a* from the triangle wave generating circuit 15 with the output voltage 7*a* determined as described above, outputs the pulse signal 6*a* having a predetermined pulse width based on the comparison and sends to the logic circuit 5, and the switching elements of the switching circuit 4 are turned on and off by the gate signals 5*a* from the logic circuit 5 thereby driving the primary side of the high-voltage transformer 2.

The output voltage 7*a* from the error amplifier 7, which is determined by the reference voltage Vref from the reference voltage circuit 21 and the resistors 16, 17 and 18, is set so as to provide a desired open voltage when the secondary side of the high-voltage transformer 2 is open. When the switching circuit 4 is operated at the above-described frequency of, the open voltage can, through the series resonance of the resonant circuit at the secondary side, be high enough to unfailingly start lighting the discharge lamp 3. In this connection, when the discharge lamp 3 is not lighted, the parasitic capacitance at the secondary side is constituted in substance by the parasitic capacitance generated between wirings and is assumed to have a smaller value than the capacitance $C_{CFL}$, so the frequency of that is to be set to range in the proximity of the series resonant frequency fss is preferably set higher than the series resonant frequency fss. Also, in the discharge lamp lighting apparatus 1, a resonant circuit is provided at the primary side of the high-voltage transformer 2, and consequently even when the discharge lamp 3 is not turned on, the distortion and the asymmetry of the output waveform of the high-voltage transformer 2 can be reduced thus providing an output with a substantially sinusoidal waveform.

Description will now be made on the operation when the discharge lamp 3 is lighted. After the discharge lamp 3 is turned on and lighted, the inverter element 11 of the frequency changing means 25 has its output reduced to a low level by the feedback voltage signal 19*a* which is converted from the lamp current IL by the lamp current detecting resistor 19, and the transistor 12 is turned off. Accordingly, only the resistor 14 is connected to the triangle wave generating circuit 15, and the frequency of the triangle wave 15*a*, which is determined by the value of the resistor 14 and the value of the capacitor 26, is shifted to be lower than the above-described frequency of measuring when the discharge lamp is not lighted. Here, the frequency of the triangle wave 15*a* is set at a frequency (hereinafter denoted "fo'") ranging in the proximity of the frequency at which the voltage-current phase difference at the primary side of the high-voltage transformer 2 is minimized. In this connection, the high-voltage transformer 2 is adapted to operate with a good power efficiency at a frequency where the voltage-current phase difference at the primary side is small, and it is known that the frequency ranges below the series resonant frequency fss. In present embodiment, the frequency fo' may be set such that the phase difference ranges between 0 to −30 degrees.

Also, when the discharge lamp 3 is lighted, the transistor 20, to which the feedback voltage signal 19 is applied via the diode D1, is turned on, and therefore the error amplifier 7 to set an open voltage is caused to stop its operation. In this case, the PWM circuit 6 compares the triangle wave 15*a* from the triangle wave generating circuit 6 with the output voltage 8 from the error amplifier 8 to set a lamp current, and outputs the pulse signal 6*a* to the logic circuit 5 based on the comparison. Then, the switching elements of the switching circuit 4 are turned on and off by the gate signals 5*a* from the logic circuit 5 thereby driving the primary side of the high-voltage transformer 2.

The feedback voltage signal 19*a* is fed back to the inverting input terminal of the error amplifier 8, and the output voltage 8*a* of the error amplifier 8 is determined according to the error deviation from the reference voltage Vref inputted to the non-inverting input terminal of the error amplifier 8. Thus, the PWM circuit 6 modulates the pulse width of the pulse signal 6*a* according to the lamp current IL thereby performing the constant current control of the discharge lamp 3.

Further, the protection circuit 10 incorporates a comparator circuit (not shown), and when a transformer current detecting signal 9*a* outputted from a transformer current detecting resistor 9 provided at the lower-voltage side of the high-voltage transformer 2 exceeds the reference voltage of the comparator circuit, the logic circuit 5 is caused to stop its operation thereby preventing overcurrent and overvoltage from flowing into the discharge lamp 3 and the high-voltage transformer 2, respectively. And, the output voltages 7*a* and 8*a* of the error amplifiers 7 and 8 are also applied to the protection circuit 10 and compared with the reference voltage of the comparator circuit, and if the output voltages 7*a* and 8*a* are found to exceed the reference voltage, the logic circuit 5 is caused to stop its operation.

A second embodiment of the present invention will hereinafter be described with reference to FIG. 5. A discharge lamp lighting apparatus 30 according to the second embodiment of the present invention is suitable for lighting two (or more) discharge lamps and is structured identical with the discharge lamp lighting apparatus 1 according to the first embodiment except for the structure of a high-voltage transformer, and description will be focused on the difference.

Figure 5:
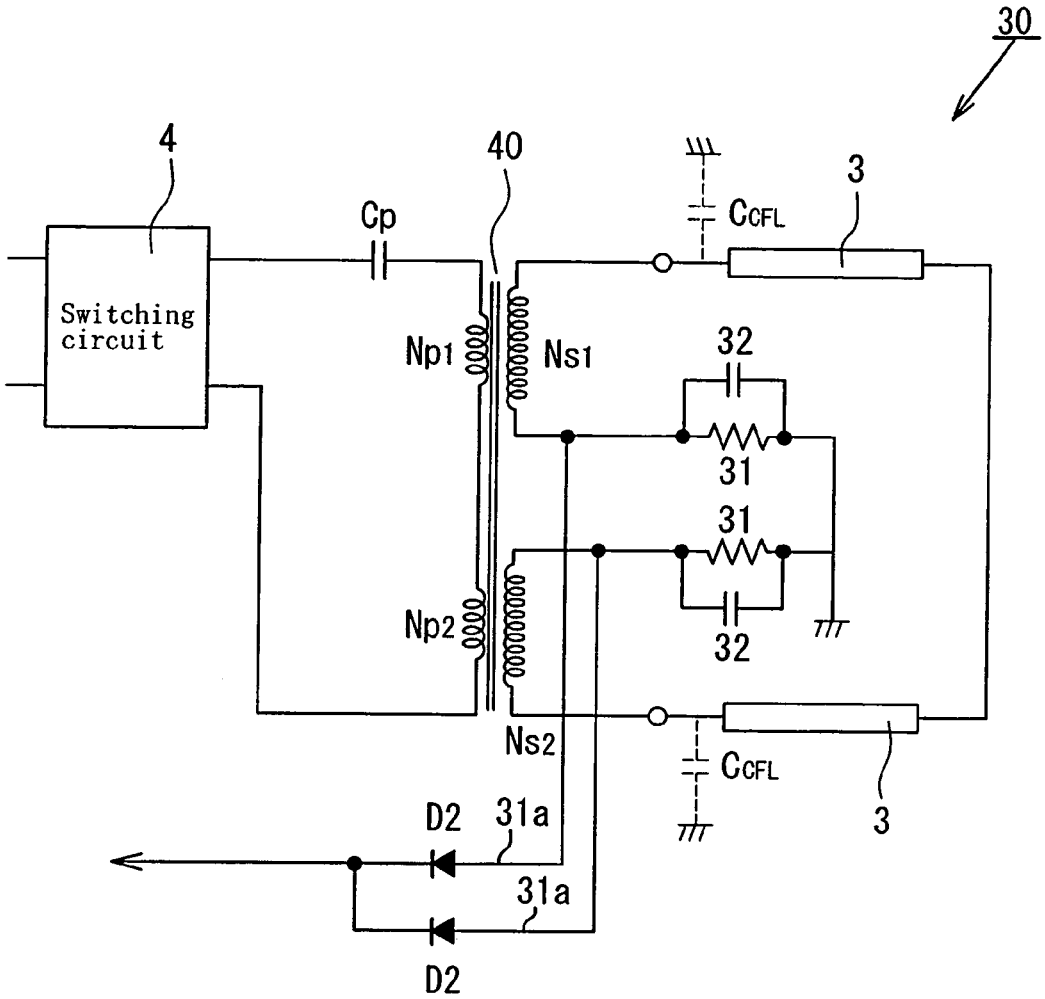
FIG. 5 is a block diagram of a relevant part of a discharge lamp lighting apparatus according to a second embodiment of the present invention.
Figure 6:
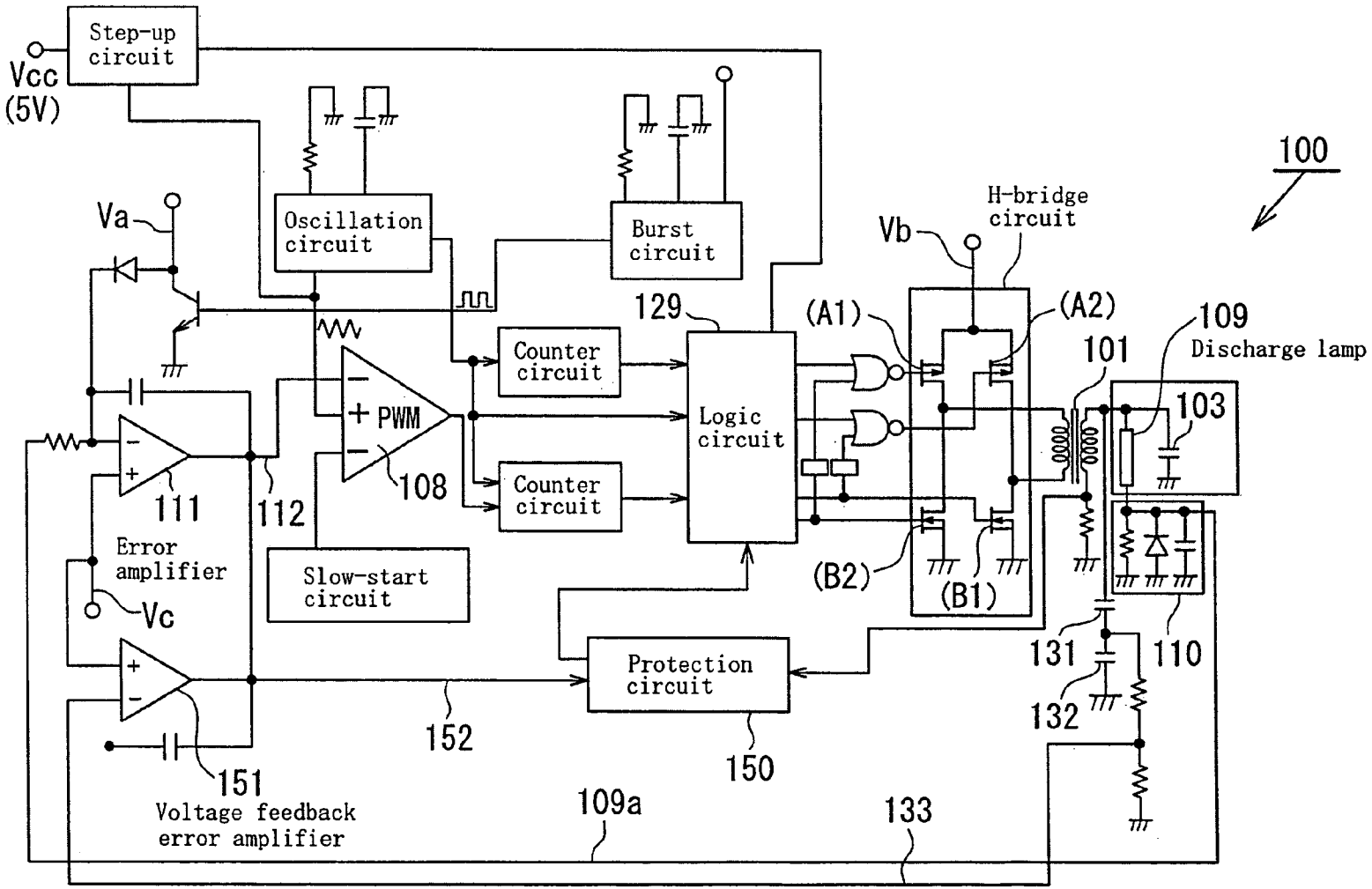
FIG. 6 Prior Art
FIG. 6 is a block diagram of a conventional discharge lamp lighting apparatus.

Referring to FIG. 5, the discharge lamp lighting apparatus 30 includes a high-voltage transformer 40 which has two primary windings Np1 and Np2 connected to each other in series, and has two secondary windings Ns1 and Ns2 separated from each other wherein one terminal of each of the secondary windings Ns1 and Ns2 is connected to one terminal of each of two discharge lamps 3 while the other terminals of the secondary windings Ns1 and Ns2 are grounded via respective resistors 31. A capacitor 32 is connected in parallel to each of the resistors 31, and respective other (lower-voltage side) terminals of the discharge lamps 3 are connected to each other. In FIG. 5, $C_{CFL}$ is a parasitic capacitance generated at the discharge lamp 3. Lamp currents flowing in the discharge lamps 3 are converted into feedback voltage signals 31*a* by the resistors 31, and are inputted to the transistor 20, the error amplifier 8 to set a lamp current, and the frequency changing means 25, which are shown in FIG. 1.

In the second embodiment shown in FIG. 5, the two discharge lamps 3 are each shaped straight and are connected to each other in series, but the present invention is not limited to this structure and arrangement and it may be structured and arranged such that one discharge lamp shaped, for example, in U- or square U-letter configuration is connected to the high-voltage transformer with the both terminals of the discharge lamp connected respectively to the secondary windings Ns1 and Ns2. Also, the connection portion between the two discharge lamps 3 as shown in FIG. 5 may be grounded. And, the primary winding of the high-voltage transformer 40 may be composed of one winding, or structured such that the two windings Np1 and Np2 are connected to each other in parallel.

While the present invention has been illustrated and explained with respect to specific embodiments thereof, it is to be understood that the present invention is by no means limited thereto but encompasses all changes and modifications that will become possible within the scope of the appended claims.

What is claimed is:

1. A discharge lamp lighting apparatus comprising:

a high-voltage transformer defining a primary side and a secondary side;

a switching circuit to drive the primary side of the high-voltage transformer;

a discharge lamp connected to the secondary side of the high-voltage transformer;

a frequency changing means to change an operating frequency of the switching circuit according to lighting conditions of the discharge lamp before and after the discharge lamp is turned on;

a first resonant circuit formed at the primary side of the high-voltage transformer and having a specific resonant frequency; and a second resonant circuit formed at the secondary side of the high-voltage transformer and having a specific resonant frequency different from the resonant frequency of the first resonant circuit, wherein the switching circuit, before the discharge lamp is turned on to be lighted, is operated at a frequency ranging in proximity of a series resonant frequency of the second resonant circuit, and, after the discharge lamp is turned on and lighted, is operated at a frequency ranging in proximity of a frequency at which a voltage-current phase difference at the primary side of the high-voltage transformer is minimized.

2. A discharge lamp lighting apparatus according to claim 1, wherein a capacitance component of the first resonant circuit is constituted by a capacitor connected either in series or parallel to a primary winding of the high-voltage transformer, and a capacitance component of the second resonant circuit is constituted only by a parasitic capacitance generated at the secondary side of the high-voltage transformer.

3. A discharge lamp lighting apparatus according to claim 1, wherein the resonant frequency of the first resonant circuit is set lower than a parallel resonant frequency of the second resonant circuit.

4. A discharge lamp lighting apparatus according to claim 1, further comprising an error amplifier to set an open voltage, wherein an output voltage, when the secondary side of the high-voltage transformer is open, is controlled according to a supply voltage and a predetermined reference voltage, both of which are inputted to the error amplifier.

5. A discharge lamp lighting apparatus according to claim 1, wherein the switching circuit is one of a full-bridge circuit and a half-bridge circuit.

6. A discharge lamp lighting apparatus according to claim 1, wherein the series resonant frequency of the second resonant circuit formed at the secondary side of the high-voltage transformer is determined by a leakage inductance at a secondary winding of the high-voltage transformer and the parasitic capacitance at the secondary side.

* * * * *